United States Patent [19]

Marega et al.

[11] Patent Number: 4,974,346

[45] Date of Patent: Dec. 4, 1990

[54] HULL FOR SKI-BOOTS

[76] Inventors: Antonello Marega, Via San Gaetano 51, 31044 Montebelluna (Treviso); Pierluigi Lorati, Piazzale Europa 13, 25026 Ponte di Legno (Brescia), both of Italy

[21] Appl. No.: 374,061

[22] Filed: Jun. 30, 1989

[30] Foreign Application Priority Data

Jun. 30, 1988 [IT] Italy ..... 21516/88[U]

[51] Int. Cl.[5] ..... A43B 5/04

[52] U.S. Cl. ..... 36/117; 36/121

[58] Field of Search ..... 36/117, 118, 119, 121, 36/54, 120, 115

[56] References Cited

U.S. PATENT DOCUMENTS

| | | | |
|---|---|---|---|
| 3,593,435 | 7/1971 | Lange | 36/120 |
| 3,668,791 | 6/1972 | Salzman | 36/117 X |
| 3,686,778 | 8/1972 | Hornung | 36/120 |
| 3,696,534 | 10/1972 | Hornung | 36/121 |
| 3,877,158 | 4/1975 | McCutchan, II | 36/120 |
| 4,085,528 | 4/1978 | Delery | 36/121 |
| 4,245,410 | 1/1981 | Molitor | 36/117 |
| 4,406,073 | 9/1983 | Spademan | 36/54 X |

FOREIGN PATENT DOCUMENTS

| | | | |
|---|---|---|---|
| 278281 | 8/1988 | European Pat. Off. | 36/117 |
| 3004668 | 8/1981 | Fed. Rep. of Germany | 36/117 |
| 693341 | 8/1965 | Italy | 36/121 |

*Primary Examiner*—Paul T. Sewell
*Assistant Examiner*—Andrew D. Meyers

[57] ABSTRACT

Between an upper portion and a leg portion of the plastic shell of ski-boots a slot is provided, which is closed by internal tongues for sealing the slot with respect to water and snow.

6 Claims, 6 Drawing Sheets

Fig.3
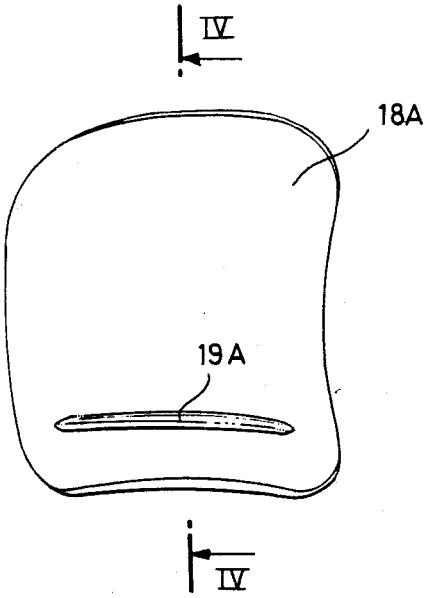
Fig.5
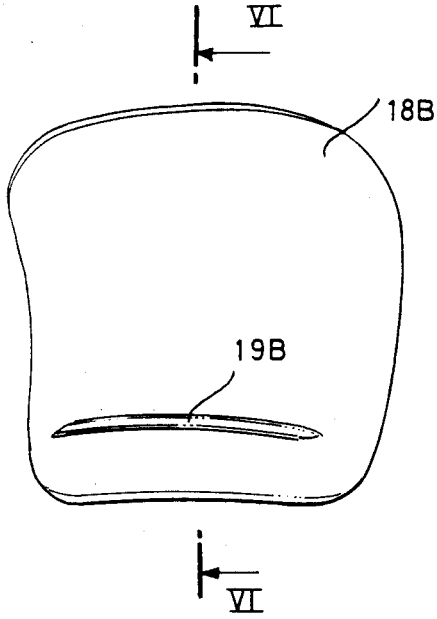
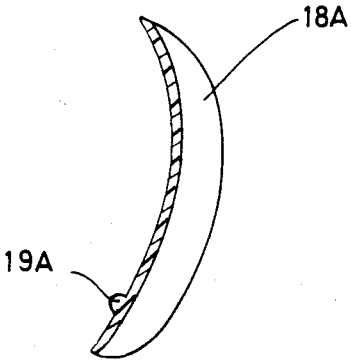
Fig.4
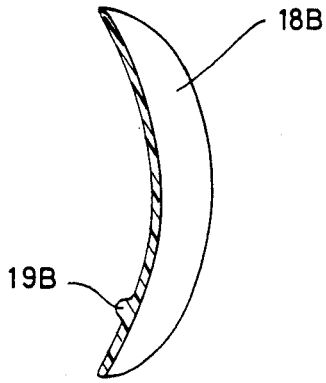
Fig.6

HULL FOR SKI-BOOTS

The present invention relates to improved ski boots and particularly to an improved hull for ski boots made of plastic material.

It is known that ski boots may be manufactured from plastic material, preferably through injection molding of thermoplastic material and such boots consist of a hull (shell) having a sole and a leg portion which is pivotally connected to the hull (shell) and adapted to be clamped around the leg of the skier near to the ankle. Within the hull a suitably padded internal shoe is placed.

The hull is manufactured as a single piece, with an upper end having a more flexible portion around which the aforesaid leg portion is mounted. It is evident that the foot must be introduced through this upper end of the hull, and to date the opening width of this end, for example measured as a diagonal distance between the foot neck and the heal, has been kept relatively wide so as to not excessively hinder the introduction of the foot into the boot. This wide opening is contrary to the desire of keeping the hull as closely fitted to the foot as possible, since a close fit means a better transmission of command from the leg and from the foot of the skier to the ski which is secured to the sole of the ski boot.

In addition to the above problem, another problem is possible, depending on the nature of the plastic material from which the ski boot and thus the hull is manufactured. The intrinsic rigidity of the plastic material makes it difficult to provide a good shaping of the internal surface of the hull to the foot neck, taking into account that even a small pressure acting on the foot neck is certainly objectionable as regard the wearing comfort and, in extreme cases, causes a painful pressure localized on the abducting tendon of the big toe.

Before the appearance of the ski boots molded of plastic material, which took place at the beginning of the nineteen seventies, the ski boots were manufactured from leather, and the upper was provided with a central lacing closure or with a sidewise closure with buckles or hooks for the closure. In that case, the leather boots provided, in the portion around the foot neck, a relieving opening in which a leather portion in excess at the curve of the foot neck was eliminated. With the introduction of the molding technology with plastic material, as well as precise molding dies, the plastic boots were shaped according to the foot contour and these relieving openings lost their reason for being and were eliminated.

It has been now surprisingly found that, if in the upper part of the hull corresponding to the foot neck, i.e. around the ankle, a substantially horizontal slot is formed, not only is the easiness for the foot insertion in the ski boot increased, but the diagonal length of the neck-heel is reduced, whereby the closeness of fit of the hull to the foot is corresponding increased with the obvious consequential advantages. Moreover, the clamping, i.e. tightening, of the upper part of the hull to the foot may be essentially independent from the clamping, i.e. tightening of the more rigid lower part of the hull, and the clamping pressure on the ankle and on the foot neck is capable of adjustment.

In the preferred embodiment of the ski boot according to the present invention, the front upper portion of the hull is provided with a crosswise slot, whereby the front portion of the hull has two mating or partially overlapping lower parts and two overlapping upper parts, with each of the two parts being partially movable independent of the two other parts. The upper parts and lower parts are separated by the slot, and the slot has closing tongues in order to ensure the sealing of the slot against the infiltration of water and/or snow. The peculiar features and advantages of the present invention shall appear more clearly from the following detailed description of the preferred embodiment which is with respect to the accompanying drawings in which:

FIGS. 3 and 5 are front views of the two tongues, respectively the right side and left side tongue, for sealing against the infiltrations of water and/or snow;

FIGS. 4 and 6 are perspective cross-section views along lines IV—IV and VI—VI of FIGS. 3 and 5;

Figure 7:
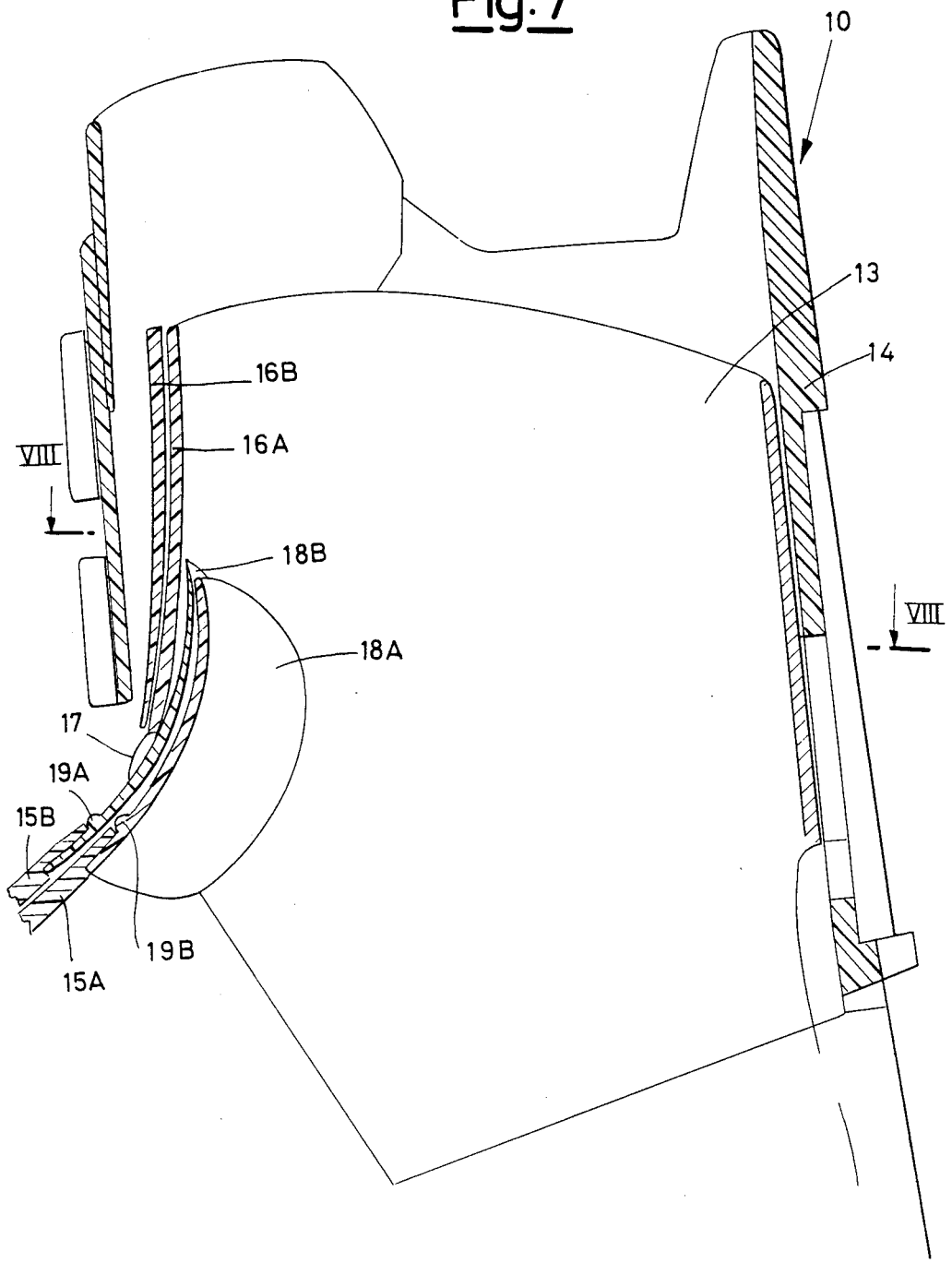
FIG. 7 is a detailed view, in enlarged scale and partially in cross-section, of the part of the hull in regard to which the present invention pertains.
Figure 8:
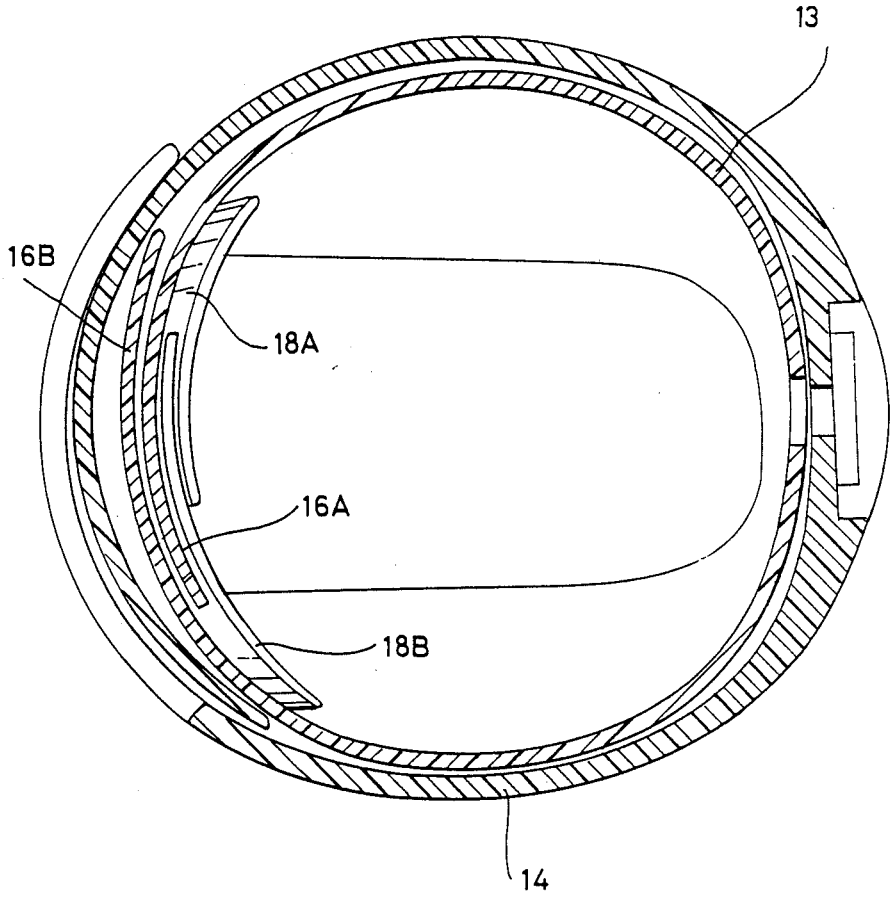
FIGS. 8 and 9 are perspective cross-section views along lines VIII—VIII of FIG. 7 and IX—IX of FIG. 1.
Figure 9:
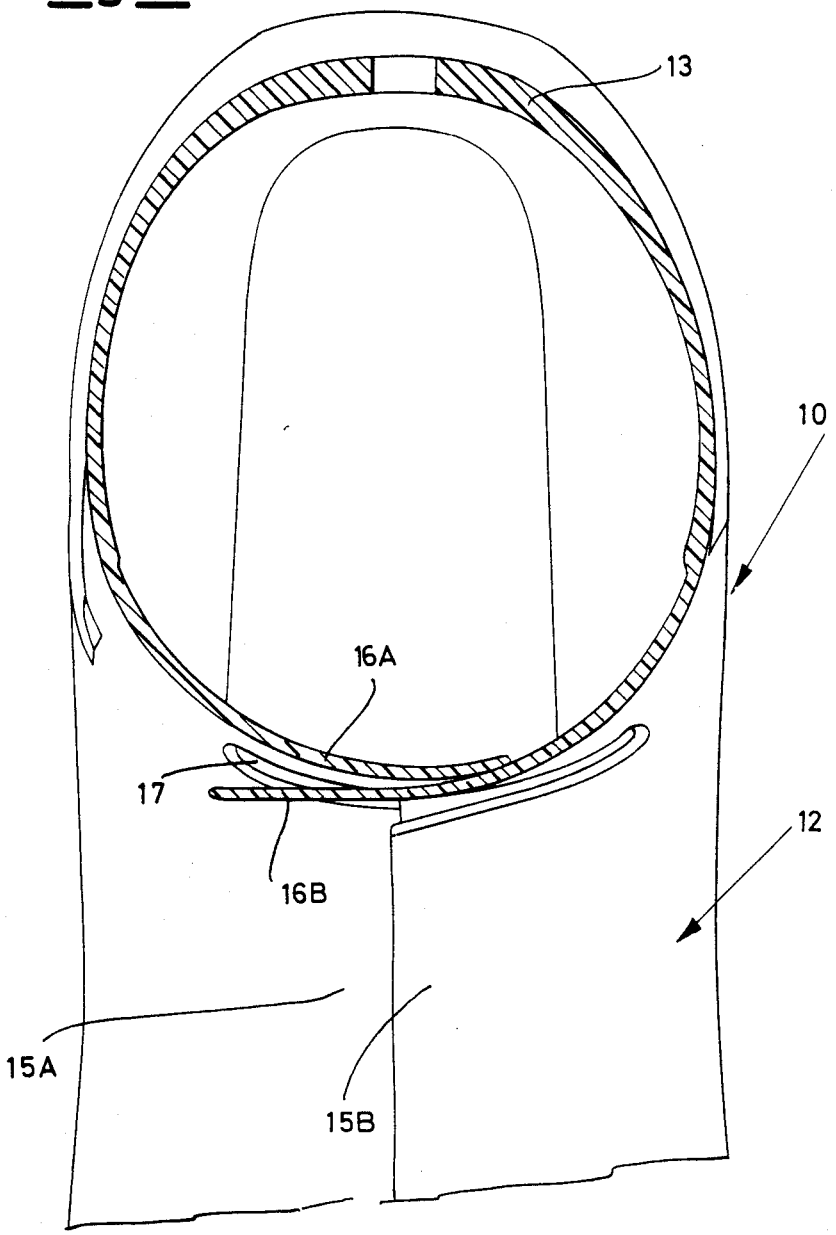

Referring to the drawings, the hull 10 comprises a sole 11 and an upper 12 to which a leg portion 13 is joined as a one-piece molding. On leg portion 13, an outer boot leg 14 is pivotally mounted (FIG. 7). As clearly seen in FIG. 2, the upper 12 is in the front part of the boot, divided in two lower half parts 15 (A,B) by means of a longitudinal cut, i.e. a vertical opening. In turn, the leg portion 13 is formed, in the front part of the boot, with two leg portion half parts 16 (A,B) which are overlapping. Between the upper 12 and the leg portion 13, a slot 17 is formed in a cross-wise direction with respect to the longitudinal central cut (vertical opening) of the upper and leg portion and along the crosswise curvature of the upper 12.

Figure 1:
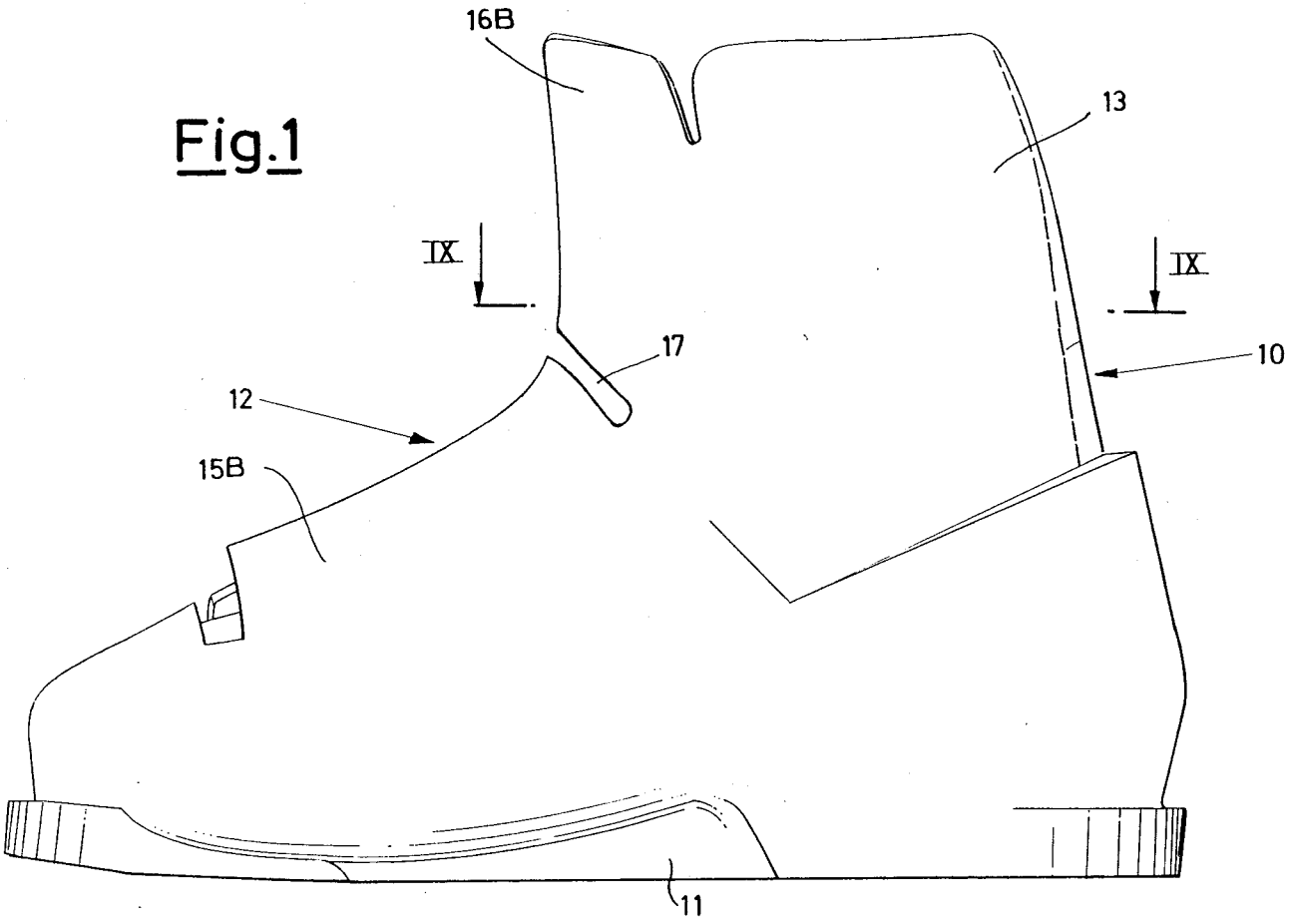
FIG. 1 is a schematic side view of the hull of a ski boot according to the present invention.
Figure 2:
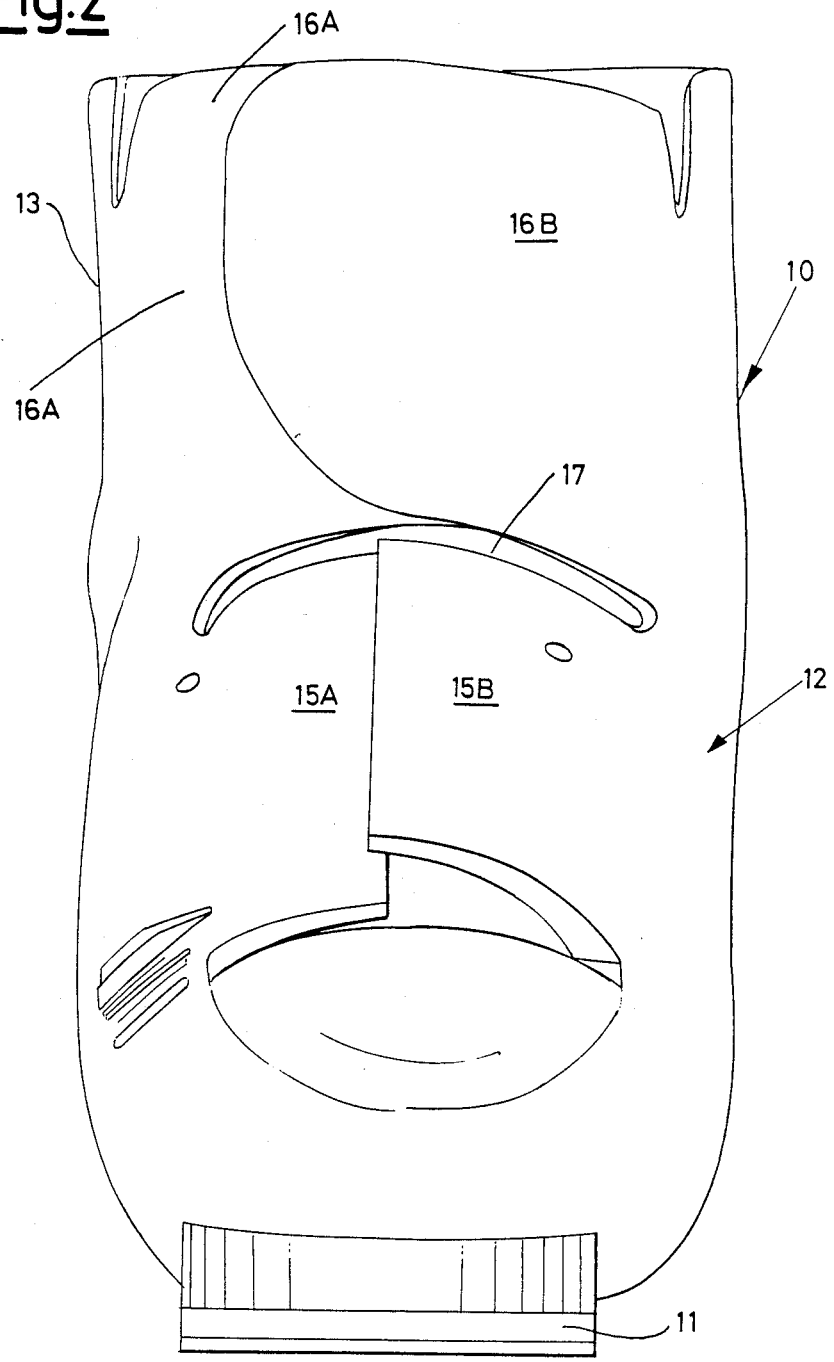
FIG. 2 is a front view of the hull of FIG. 1.

From the FIGS. 1 and 2, it is clearly seen that the slot 17 is positioned at the foot neck and more precisely at the front articulation of the leg to the foot, i.e. at the ankle. In this manner each lower half 15*a*, 15*b* is connected to the corresponding leg portion half parts 16A, 16B, so that limited movement is possible because of the slot 17 which partially divides the corresponding parts. If the neck-heel diagonal length of a boot of the present invention is compared with a hull of the same size of boot of a previous type, it is found that in the former such a diagonal length is less by about 6–7 millimeters, which, in terms of closeness of tightening of the hull to the foot, corresponds to a hull with at least one number lower in size, apart from the length of the foot. It is self-evident that the better the tightness of the hull to the foot wearing the internal show the better. An additional advantage is the novel deformation of the boot with respect to the side direction of the lower part of the hull. Further, with the adjustability of the parts 15 (A,B) and 16 (A,B) it is much easier to place the foot into the ski boot, in comparison with a standard ski boot without the slot 17.

As already mentioned, in order to provide sealing against water and/or snow egress into the hull through slot 17, the present invention provides sealing tongues 18 (A,B), shaped so as to fit the curvature of the leg portion 13 immediately above and under the slot 17. Each tongue 18 (A,B) is fixed to the internal part of the hull, for example by thermowelding, by means of a one piece protruding rib 19 (A, B) to slot 17, at the upper or lower edge of slot 17 and within the internal part of the hull, whereby the desired sealing is obtained without interference with the functionality of the parts 15 (A,B) and 16 (A,B). It is however understood that modifications and variations, conceptually and mechanically equivalent to the tongue 18 (A,B) may be used as sealing means, and such are intended to be within the scope of the present invention.

We claim:

1. In a shell for a ski boot and having an upper and a leg portion with each of the upper and leg portion being divided into two parts by vertical openings in the upper and leg portion, the improvement comprising:

between said upper and said leg portion and in the front of the shell there is disposed an opened crosswise slot, whereby at least one leg portion part is separated from at least one underneath upper part by the slot so that the at least one upper part is tightenable about the foot independently of the at least one leg portion part being tightenable about the leg whereby the boot may be snugly tightened about the foot and leg without undue pressure being exerted on either the foot or the leg.

2. Improved shell of claim 1 wherein at least one tongue is fixed to the shell so that the at least one tongue seals the slot from egress of snow and water.

3. Improved shell of claim 2 wherein there are two tongues, with one tongue fixed to an edge portion of the slot and the other tongue fixed to another edge portion of the slot so that the tongues overlap.

4. Improved shell according to claim 3 wherein each said tongue is shaped so as to fit the curvature of the leg portion immediately above and under the said slot.

5. Improved shell according to claim 3, wherein each said tongue is provided with a securing rib.

6. Improved shell according to claim 5, wherein each said tongue is fastened to an internal part of the shell by theremowelding of the rib.

* * * * *